US006966244B2

(12) United States Patent
Herbst et al.

(10) Patent No.: US 6,966,244 B2
(45) Date of Patent: Nov. 22, 2005

(54) NON-METALLIC HAND PLIERS WITH WIRE CUTTER

(75) Inventors: Richard Herbst, Sarasota, FL (US); Dale T. Walker, Palm Harbor, FL (US); Robert Brady, Sarasota, FL (US)

(73) Assignee: Role Associates, Sarasota, FL (US)

( * ) Notice: Subject to any disclaimer, the term of this patent is extended or adjusted under 35 U.S.C. 154(b) by 60 days.

(21) Appl. No.: 10/702,939

(22) Filed: Nov. 6, 2003

(65) Prior Publication Data

US 2005/0097998 A1 May 12, 2005

(51) Int. Cl.[7] ..... B25B 7/22
(52) U.S. Cl. ..... 81/418; 81/421; 7/133; 30/186
(58) Field of Search ..... 81/418, 416, 427.5, 81/900, 421, 181; 7/129–134; 30/173, 186, 30/191–193, 145, 175, 236, 260, 349

(56) References Cited

U.S. PATENT DOCUMENTS 254,435 A * 2/1882 Foote ..... 7/133
651,082 A * 6/1900 McClary ..... 7/133
4,023,450 A 5/1977 Ygfors
4,185,523 A 1/1980 Kreitz
5,003,695 A * 4/1991 Lipscomb et al. ..... 30/193
5,865,077 A 2/1999 Moffitt
5,987,750 A * 11/1999 Tally ..... 81/416
6,202,518 B1 3/2001 Moffitt
6,530,099 B1 * 3/2003 Iwinski ..... 81/416
6,591,506 B2 * 7/2003 Hackman ..... 30/229
6,725,546 B1 * 4/2004 Dallas et al. ..... 7/133
6,776,073 B1 * 8/2004 Brady et al. ..... 81/416

* cited by examiner

*Primary Examiner*—Hadi Shakeri
(74) *Attorney, Agent, or Firm*—Charles J. Prescott

(57) ABSTRACT

A pair of preferably substantially buoyant-in-water hand pliers comprising a pair of non-metallic lever members each having a handle portion and a jaw portion and formed of material preferably having a density greater than water. The lever members are pivotally connected together at common central portions between the jaw and handle portions. Each handle portion preferably has one or more outwardly opening cavities formed into a side surface of the handle portions. An elongated tubular sheath preferably formed of material buoyant in water covers and sealingly encloses the cavities whereby the effective density of the pliers is less than that of water. An effective, durable, non-corrosive wire cutting arrangement is also provided, the components uniquely configured and supported in the non-metallic jaw portions.

30 Claims, 5 Drawing Sheets

NON-METALLIC HAND PLIERS WITH WIRE CUTTER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to hand tool construction, and more particularly to a lightweight preferably non-conductive pair of pliers preferably having water buoyant characteristics and a durable, effective wire cutter for use by fishermen and boaters and others using such tools in the vicinity of water and/or electricity.

2. Description of Related Art

Boaters and fishermen and others who use hand tools in the vicinity of water are notorious for dropping hand tools irretrievably into the water. If the tool happens to be fabricated of metallic material, magnets may be used at the end of a long flexible line to afford some chance of retrieval. Additionally, use of metallic hand tools around salt water will quickly cause substantial, detrimental corrosion in the form of surface rust on such hand tools. Moreover, those conventional pliers which include a wire cutter do not work well at cutting high-tensile strength steel or stainless steel solid or braided leader wire. Another concern for users of such hand tools is with respect to the presence of water on the ground or floor surface or carelessness while using a conductive hand tool around sources of electric power and energized wiring and connectors therefor.

To address the issue of buoyancy in water, Kreitz teaches a set of floating pliers in U.S. Pat. No. 4,185,523 wherein a block of closed cell polymeric foam is inserted between the handle portions of the lever members to provide sufficient flotation to render the pliers buoyant and also to provide a resilient automatic jaw opening mechanism during use.

In U.S. Pat. No. 5,865,077, Moffitt discloses floating, non-conductive hand tools in the form of pliers or channel locks which utilize non-conductive lever members pivotally connected together. Water buoyancy is achieved either by entrapping gas or air within a sealed airtight hollow cavity formed within the handle portion of each lever member by special manufacturing methods and apparatus and/or by providing a closed-bottomed sheathing material having a low density substantially below that of water fitted over the end of the handle portion of each lever member. A further enhancement of that disclosure by Moffift is shown in U.S. Pat. No. 6,202,518 which additionally teaches wear resistant removable jaw members and a line cutter for nylon and fabric line only and being interconnected to one of the handle portions of one lever member thereof.

Pliers made from a plastic material are disclosed in U.S. Pat. No. 4,023,450 invented by Ygfors whose basic object is to produce pliers suitable for picking up small objects.

The present invention discloses a light weight preferably non-conductive, substantially non-corrosive preferably water buoyant pair of pliers which achieves water buoyancy through the cooperative effects of an elongated low density sleeve open at each end thereof and fitted over the handle portions of each lever member to sealingly enclose one or more open air cavities formed in outwardly opening fashion into each handle portion. An effective, corrosive-resistant two-part wire cutter secured into the mating faces of the plastic jaws which easily cuts steel wire and leader line is also provided.

BRIEF SUMMARY OF THE INVENTION

This invention is directed to a pair of preferably non-conductive, buoyant-in-water hand pliers comprising a pair of non-metallic lever members each having a handle portion and a jaw portion and formed of material having a density greater than water. The lever members are pivotally connected together at common central portions between the jaw and handle portions. Each handle portion preferably has one or more outwardly opening cavities formed into a side surface of the handle portions. An elongated tubular sheath formed of material buoyant in water covers and sealingly encloses the cavity whereby the effective density of the pliers to less than that of water. An effective corrosive resistant two-part wire cutter arrangement secured into the non-metallic, preferably plastic jaws is also provided.

It is therefore an object of this invention to provide a lightweight preferably non-conductive pair of pliers having an effective high-strength wire cutter arrangement.

It is another object of this invention to provide a substantially non-corrosive pair of pliers which are substantially water buoyant, particularly in salt water and which will cut braided or solid leader wire of steel or composite material.

Still another object of this invention is to provide a non-corrosive polymer or plastic pair of pliers which includes an effective wire cutting arrangement for high-strength wire.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
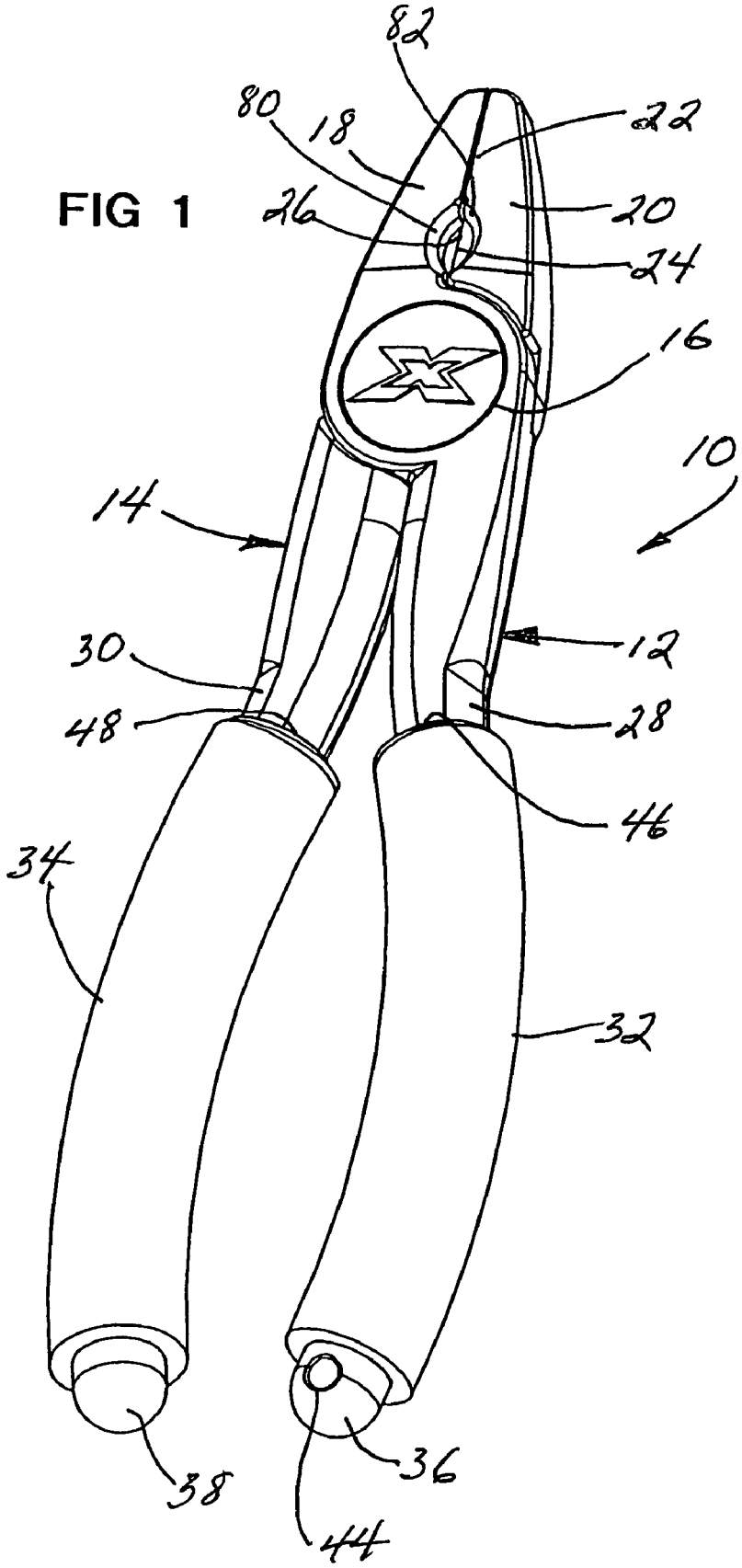
FIG. 1 is a perspective view of the invention.
Figure 2:
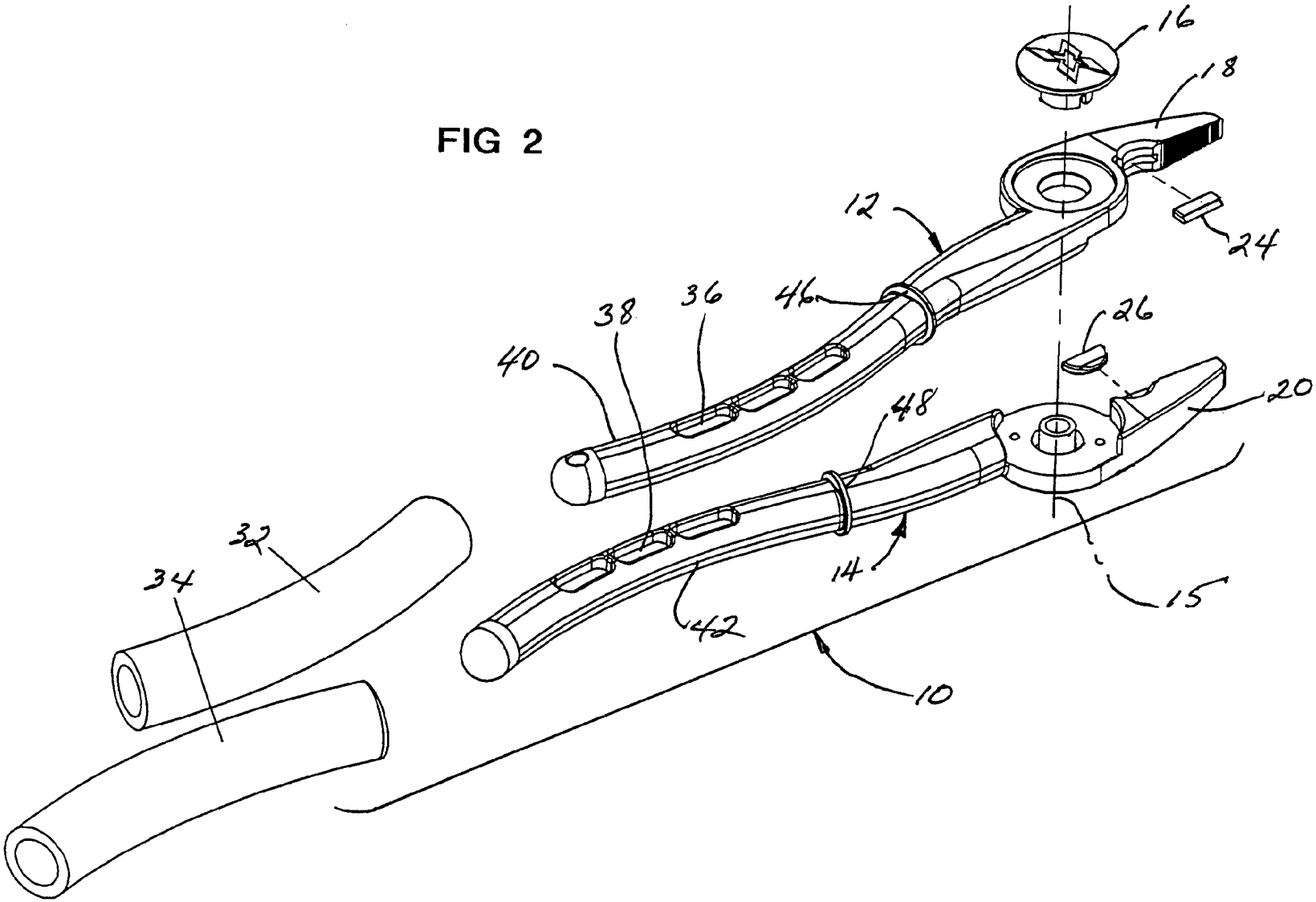
FIG. 2 is a perspective exploded view of the invention as shown in FIG. 1.
Figure 3:
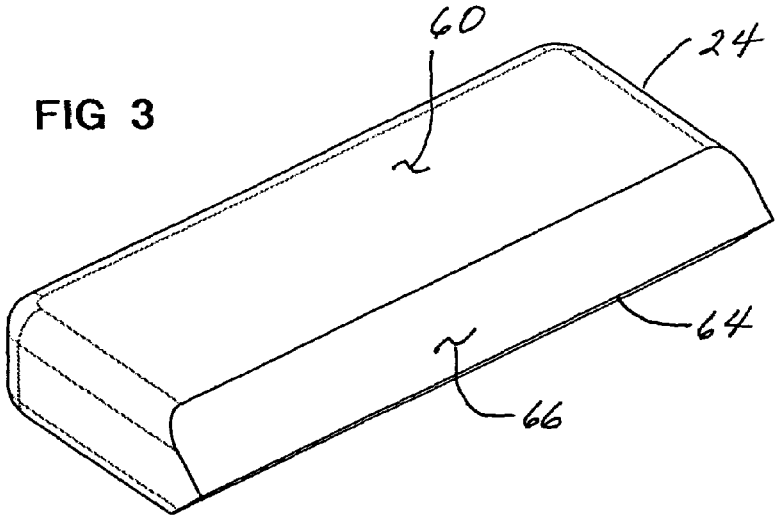
FIG. 3 is a perspective view of the wire cutting blade of the invention as shown in FIG. 1.
Figure 6:
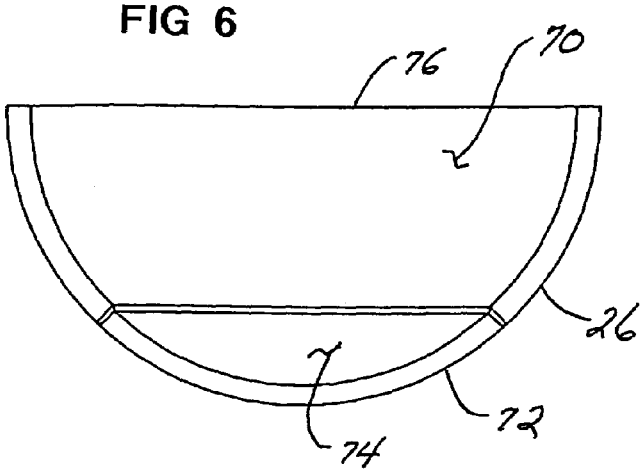
FIG. 6 is a side elevation view of the cutting anvil of FIG. 1.
Figure 7:
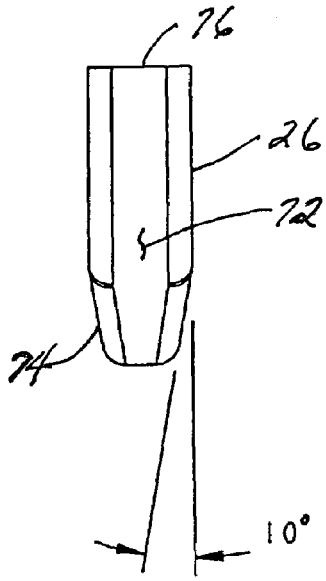
FIG. 7 is an end elevation view of FIG. 6.
Figure 8:
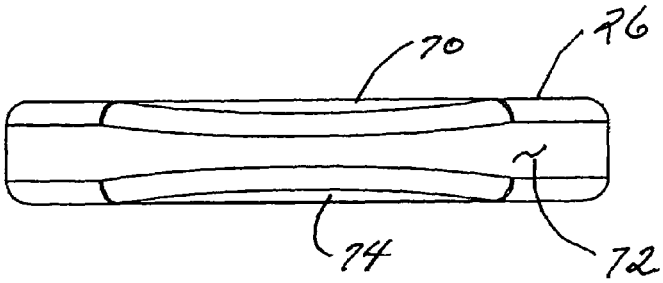
FIG. 8 is a bottom plan view of FIG. 6.
Figure 4:
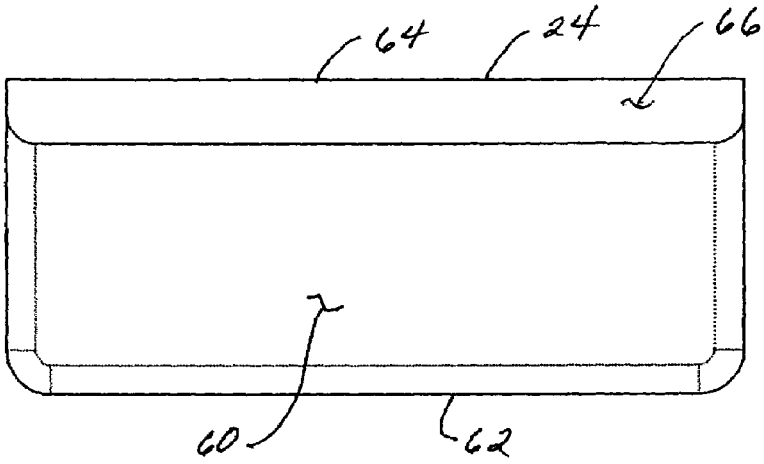
FIG. 4 is a side elevation view of FIG. 3.
Figure 5:
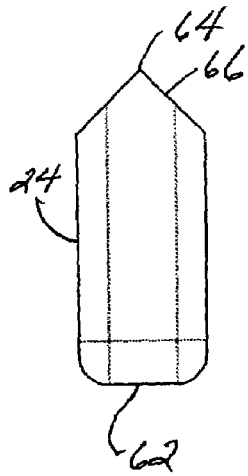
FIG. 5 is an end elevation view of FIG. 4.

Referring now to the drawings, and particularly to FIGS. 1 and 2, the invention is there shown generally at numeral 10. This embodiment 10 is in the form of a pair of pliers having elongated handle portions 28 and 30 and shorter jaw portions 18 and 20, each forming respective end portions of lever members 12 and 14, respectively.

The two lever members 12 and 14 are pivotally connected together at their central overlapping portions about a pivotal axis 15. A retaining cap 16 secures the two lever members 12 and 14 together. These components are formed of molded plastic or fiberglass material generally, and are preferably formed of a 43% glass fiber reinforced NYLON produced by Polyplastics Celanese, NYLON PA-66, Material No. 1603-2 having a relatively low density of 1.47 g/cc. The mating facing surfaces 22 of each of the jaw portions 18 and 20, respectively, are serrated or grooved for enhanced gripping of objects therebetween when the handle portions 28 and 30 are first opened, then placed around an object and then squeezed for retention within the jaw portions 18 and 20 in a well-known manner.

Each of the handle portions 28 and 30 are substantially covered by tubular low-density sleeves 32 and 34. Each of these sleeves 32 and 34 are formed of ethylene vinyl acetate (EVA) having a wall thickness of approximately 0.12" and a density of approximately 0.12 g/cc. This foam material is of a closed cell design for air tightness and lightweight characteristics.

Each of the handle portions 28 and 30 include stops or flanges 46 and 48 which limit the longitudinal movement of the sheaths 32 and 34 when installed over the handle portions 28 and 30. A lanyard aperture 44 is provided in one of the distal ends 36. By this arrangement, each of the sheaths 32 and 34 are slidably installed onto the handle portions 28 and 30, respectively, against the flanges 46 and 48 to prevent any further longitudinal movement along the handle portions 28 and 30.

Referring now to FIGS. 3 to 10, the wire cutting aspect of the invention is there shown. This wire cutting aspect includes a wire cutting blade 24 and a mating anvil 26, each of which is securely embedded into mating cavities molded into the facing jaw surfaces of the lever members 12 and 14.

Figure 9:
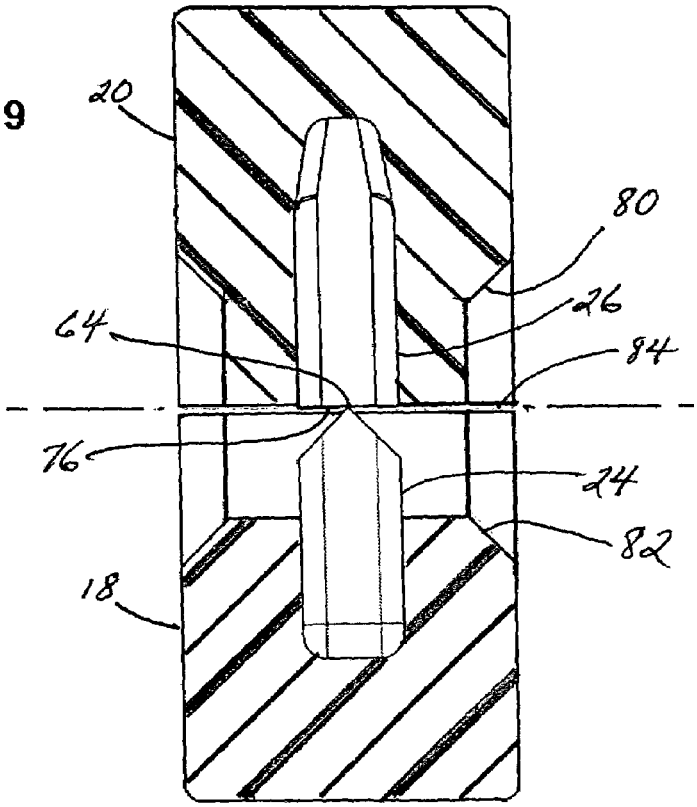
FIG. 9 is a transverse section view of the invention through the center of the cutting blade and anvil and respective supporting jaws associated therewith.
Figure 10:
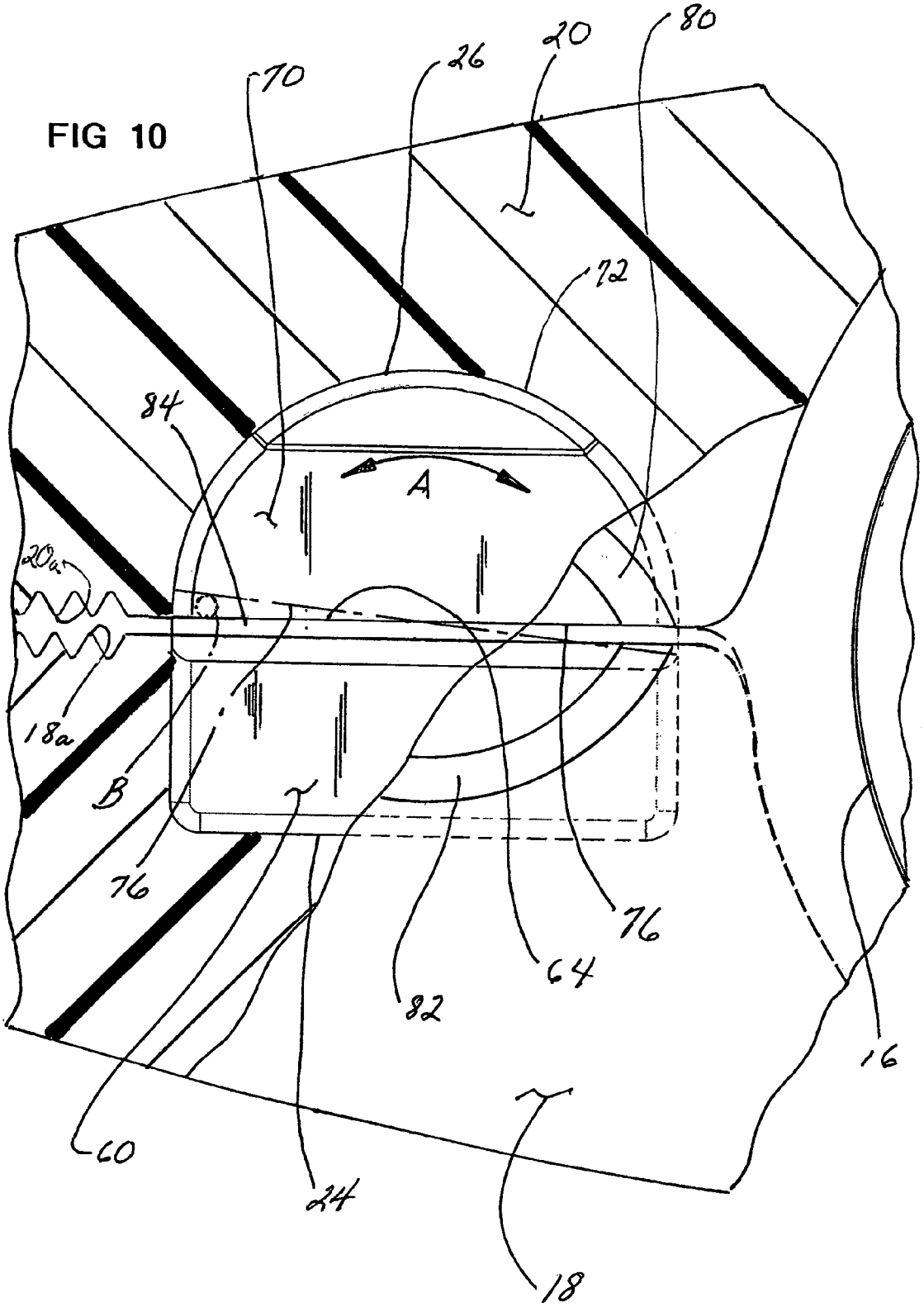
FIG. 10 is a side elevation enlarged partially broken view of the jaw portion and wire cutting components of the invention.

As best seen in FIGS. 9 and 10, the cutting blade 24 is embedded into one of the jaws 18 while the anvil 26 is embedded into the other jaw 20 such that the cutting edge 64 is aligned with and makes central longitudinal contact with the flat anvil face 76. Clearance scallops 80 and 82 are also provided. The cutting blade 24 is formed of class C2 micrograine tungsten-carbide material having a thickness of 0.087", a length of 0.5" and a width of 0.216". The side bevels 66 are at an angle of 45° one to another with respect to the parallel side surfaces 60. The embedded straight longitudinal edge 62 is radiused to the sides 60 for ease of assembly into the mating cavity formed into jaw 18.

The anvil 26 is also formed of class C2 micrograine tungsten-carbide material having a thickness of 0.087", a length of 0.5" and a width of 0.25". The profile 72 embedded within jaw 20 is preferably semi-circular, the purpose of which will be described in more detail herebelow. Tapered side surfaces 74 furthermost from the flat anvil surface 76 are tapered at an angle of 10° with respect to the side surfaces 70 to facilitate installation of the anvil 26 into preformed mating cavities within each jaw 20.

Referring particularly to FIGS. 9 and 10, the cutting blade 24 and the anvil 26 are secured within precisely mating pockets formed orthogonally into facing jaw surfaces of the jaws 18 and 20 by incorporating both an interference press fit and the use of an adhesive. Preferably, LOCKTITE 406, which is a rigid cyanoacrylate CA bonding material, not only forms an extremely strong bond, but also fills any small microgaps between the molded cavity and the corresponding cutting blade 24 and anvil 26 to enhance the securement of the cutting blade 24 and the anvil 26 in the designed position. Alternately, a flexible CA-type glue may be utilized which has additional impact strength and which provided a greater retention force should the bond be displaced slightly.

Should an extremely hard wire segment shown in phantom at B in FIG. 10, be cut at a point which is off center from each end of the mating cutting blade 24 and anvil 26, the anvil 26 may rotate in the direction of arrow A such that the anvil surface 76 in phantom becomes misaligned with the cutting edge 64 of the cutting blade 26. Should this occur, because the embedded periphery 72 is semi-circular, the jaws 18 and 20 only need be closed and the handle portions 40 and 42 squeezed together to exert sufficient force between the cutting edge 64 and the flat anvil surface 76 to realign these two surfaces by corresponding rotation of the entire anvil 26 back into the realigned position shown in solid line in FIG. 10.

A small clearance gap 84 between the facing jaw surfaces of jaw portions 18 and 20 is also provided so that the resiliency of the non-metallic or plastic material forming the jaw portions 18 and 20 may be compensated for so as to insure that the cutting edge 64 and the anvil surface 76 always make contact before the facing surfaces of the jaw portions 18 and 20 do so. By this arrangement, the resiliency of the material forming the jaw portions will elastically deform sufficiently by handle portion pressure to cause the cutting blade 24 and the anvil 26 to resiliently deform the mating pockets within the jaw portions 18 and 20 so that the facing jaw surfaces 18*a* and 20*a* will physically touch to grasp very thin objects. This initial gap is in the range of 0.02" to 0.04".

Buoyancy in Water

One of the most important features of the invention, that being buoyancy in water, is achieved as shown in FIG. 2. The essence of the buoyancy of this invention is achieved through the combination of very light weight low density closed-cell foam material selected in the manufacture of each of the sheaths 32 and 34, in combination with the overall size and dimensions thereof and a series of one or more properly sized cavities 36 and 38 which are formed into the side surfaces of each of the handle portions 40 and 42.

As each of these sheaths 32 and 34 are assembled onto the handle portions 40 and 42, each of cavities 36 and 38 are automatically sealed closed. These cavities 36 and 38 are formed in open fashion into the side surfaces of each of the handle portions 42 and 40 such that, when the tightly fitting sheaths 32 and 34 formed of somewhat elastic material are slidably assembled onto the handle portions 40 and 42, the airtight sealing of these cavities 36 and 38 is achieved. Note additionally that the size of each of these cavities 36 and 38 is effectively enlarged outwardly due to the fact that the actuate configuration of the inner surface of the foam sleeves 32 and 34 extends outwardly from the open perimeter of the cavities 36 and 38.

Note further that, in the preferred embodiment shown, a plurality of cavities 36 and 38 are formed into the side surfaces in opposing inward directions of each of the handle portions 40 and 42. Thus, a somewhat "H"-shaped section is produced with sufficient plastic material utilized to form the web or central part of the "H"-shaped section of handle portions 40 and 42 for further increased depth of each of these cavities 36 and 38 toward the central plane of each of the handles 40 and 42 if desired for added buoyancy Moreover, by providing multiple cavities 36 and 38 extending in end-to-end fashion on either side surface of each of the handle portions 40 and 42, should one of the sheaths 32 or 34 be punctured or cut to the extent that water is allowed to enter into and flood one or more of the cavities, only a small portion of the buoyancy of the pliers 10 results from such a breach of air-tight status.

An example utilizing the embodiment of the invention is here provided. The pair of pliers, having an overall length of 6½", have the following additional physical characteristics:

Total weight of plastic material: (3 pcs.): 59.95 g.

Total volume of plastic (3 pcs.): 39.43 cc.

Total weight of foam sheaths (2 pcs): 3.19 g.

Total volume of foam sheaths (2 pcs): 26.62 cc.

Total volume of trapped air within the cavities collectively: (16 cavities): 4.50 cc.

When formed based upon the above described plastic material having a density of 1.47 g/cc and a foam material having a density of 0.12 g/cc, the effective density of the entire assembly was less than 1.0 g/cc, sufficient to establish buoyancy in water.

Although it is preferred to have approximately 16 to 20 individual cavities which become fully airtight and water impervious upon installation of the tubular sheaths onto the handle portions as above described, it should be understood that one elongated open cavity formed into one or both sides of one or both of the handle portions which has a sufficiently trapped air tight volume to establish the overall buoyancy in water of the pair of pliers in combination with the above described foam sheaths is within the scope of this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A pair of hand pliers comprising:

a pair of elongated substantially non-metallic lever members each having a handle portion and a jaw portion, said lever members pivotally connected together at a central portion between said jaw and handle portion of each said lever members;

each said handle portion having a plurality of separate outwardly opening cavities formed into opposing side surfaces defined by generally H-shaped transverse cross section segments of said handle portions;

an elongated tubular sheath formed of material buoyant in water and extending over and enclosing said cavities in airtight fashion, said sheaths cooperating to render said pliers substantially buoyant in water;

a non-corrosive high strength cutting blade having a straight cutting edge and being tightly embedded and bonded by an adhesive into a first mating pocket formed into an inwardly facing surface of one of said jaw portion and a non-corrosive high-strength anvil having a flat anvil surface and being tightly embedded and bonded by an adhesive into a second mating pocket formed into an inwardly facing surface of the other said jaw portion with said anvil surface in alignment and registry with and directly against said cutting edge when said jaw portions are closed together;

said jaw portions having a resiliency sufficient for said pockets to elastically deform, allowing said anvil to be self-aligning against said cutting edge when said jaw portions are forcibly closed together against one another.

2. A pair of hand pliers as set forth in claim 1, wherein: said lever members are formed substantially of plastic or fiberglass.

3. A pair of hand pliers as set forth in claim 1, wherein: said lever members are formed of fiberglass reinforced NYLON material.

4. A pair of hand pliers as set forth in claim 1, wherein: said sheaths are formed of closed cell foam material.

5. A pair of hand pliers as set forth in claim 1, wherein: said sheaths are formed of ethylene vinyl acetate having a density of about 0.12 g/cc.

6. A pair of hand pliers as set forth in claim 1, wherein: said cutting blade and said anvil are formed of tungsten-carbide.

7. A pair of hand pliers as set forth in claim 1, wherein: said cutting blade and said anvil are bonded within the corresponding said jaw portions by cyanoacrylate (CA) adhesive.

8. A pair of hand pliers as set forth in claim 1, wherein: an embedded edge of said anvil is semi-circular whereby said anvil surface is self-aligning with said cutting edge.

9. A pair of substantially buoyant-in-water hand pliers comprising:

a pair of elongated substantially non-metallic lever members each having a handle portion and a jaw portion, said lever members pivotally connected together at a central portion between said jaw and handle portion of each said lever members;

each said handle portion having an elongated open cavity formed into a side surface thereof;

an elongated tubular sheath formed of material buoyant in water and extending over and enclosing said cavities in airtight fashion, said sheaths cooperating to render said pliers substantially buoyant in water;

a non-corrosive high strength cutting blade having a straight cutting edge and being tightly embedded and bonded by an adhesive into a first mating pocket formed into an inwardly facing surface of one of said jaw portion and a non-corrosive high-strength anvil having a flat anvil surface and being tightly embedded and bonded by an adhesive into a second mating pocket formed into an inwardly facing surface of the other said jaw portion with said anvil surface in alignment and registry with and directly against said cutting edge when said jaw portions are closed together;

said jaw portions having a resiliency sufficient for said pockets to elastically deform, allowing said anvil to be self-aligning against said cutting edge when said jaw portions are forcibly closed together against one another.

10. A pair of hand pliers as set forth in claim 9, wherein: said lever members are formed substantially of plastic or fiberglass.

11. A pair of hand pliers as set forth in claim 9, wherein: said lever members are formed of fiberglass reinforced NYLON material.

12. A pair of hand pliers as set forth in claim 9, wherein: said sheaths are formed of closed cell foam material.

13. A pair of hand pliers as set forth in claim 9, wherein: said sheaths are formed of ethylene vinyl acetate having a density of about 0.12 g/cc.

14. A pair of hand pliers as set forth in claim 9, wherein: said cutting blade and said anvil are formed of tungsten-carbide.

15. A pair of hand pliers as set forth in claim 9, wherein: said cutting blade and said anvil are bonded within the corresponding said jaw portions by cyanoacrylate (CA) adhesive.

16. A pair of hand pliers as set forth in claim 9, wherein: an embedded edge of said anvil is semi-circular whereby said anvil surface is self-aligning with said cutting edge.

17. A pair of non-metallic substantially buoyant-in-water hand pliers comprising:

a pair of elongated substantially non-metallic lever members each having a handle portion and a jaw portion, said lever members pivotally connected together at a central portion between said jaw and handle portion of each said lever members;

each said handle portion having a plurality of separate outwardly opening cavities formed into opposing side surfaces defined by generally H-shaped transverse cross section segments of said handle portions;

an elongated tubular sheath formed of material buoyant in water and covering and sealingly enclosing each of said cavities whereby the effective density of said pliers is less than that of water;

a non-corrosive high strength cutting blade having a straight cutting edge and being tightly embedded and bonded by an adhesive into a first mating pocket formed into an inwardly facing surface of one of said jaw portion and a non-corrosive high-strength anvil having a flat anvil surface and being tightly embedded and bonded by an adhesive into a second mating pocket formed into an inwardly facing surface of the other said jaw portion with said anvil surface in alignment and registry with and directly against said cuffing edge when said jaw portions are closed together;

said jaw portions having a resiliency sufficient for said pockets to elastically deform, allowing said anvil to be self-aligning against said cutting edge when said jaw portions are forcibly closed together against one another.

18. A pair of hand pliers as set forth in claim 17, wherein: said lever members are formed substantially of plastic or fiberglass.

19. A pair of hand pliers as set forth in claim 17, wherein: said lever members are formed of fiberglass reinforced NYLON material.

20. A pair of hand pliers as set forth in claim 17, wherein: said sheaths are formed of closed cell foam material.

21. A pair of hand pliers as set forth in claim 17, wherein: said sheaths are formed of ethylene vinyl acetate having a density of about 0.12 g/cc.

22. A pair of hand pliers as set forth in claim 17, wherein: said cutting blade and said anvil are formed of tungsten-carbide.

23. A pair of hand pliers as set forth in claim 17, wherein: said cutting blade and said anvil are bonded within the corresponding said jaw portions by cyanoacrylate (CA) adhesive.

24. A pair of hand pliers as set forth in claim 17, wherein: an embedded edge of said anvil is semi-circular whereby said anvil surface is self-aligning with said cutting edge.

25. A pair of non-metailic hand pliers comprising:

a pair of elongated substantially non-metallic lever members each having a handle portion and a jaw portion, said lever members pivotally connected together at a central portion between said jaw and handle portion of each said lever members;

a non-corrosive high strength cutting blade having a straight cutting edge and being tightly embedded and bonded by an adhesive into a first mating pocket formed into an inwardly facing surface of one of said jaw portion and a non-corrosive high-strength anvil having a flat anvil surface and being tightly embedded and bonded by an adhesive into a second mating pocket formed into an inwardly facing surface of the other said jaw portion with said anvil surface in alignment and registry with and directly against said cutting edge when said jaw portions are closed together;

said jaw portions having a resiliency sufficient for said pockets to elastically deform, allowing said anvil to be self-aligning against said cutting edge when said jaw portions are forcibly closed together against one another.

26. A pair of hand pliers as set forth in claim 25, wherein: said lever members are formed substantially of plastic or fiberglass.

27. A pair of hand pliers as set forth in claim 25, wherein: said lever members are formed of fiberglass reinforced NYLON material.

28. A pair of hand pliers as set forth in claim 25, wherein: said cutting blade and said anvil are formed of tungsten-carbide.

29. A pair of hand pliers as set forth in claim 25, wherein: said cutting blade and said anvil are bonded within the corresponding said jaw portions by cyanoacrylate (CA) adhesive.

30. A pair of hand pliers as set forth in claim 25, wherein: an embedded edge of said anvil is semi-circular whereby said anvil surface is self-aligning with said cutting edge.

* * * * *